US011133138B2

(12) United States Patent
Domejean et al.

(10) Patent No.: US 11,133,138 B2
(45) Date of Patent: Sep. 28, 2021

(54) ELECTRIC SWITCH LIMITER POLE AND DC ELECTRIC SWITCH COMPRISING SUCH A LIMITER POLE

(71) Applicant: Schneider Electric Industries SAS, Rueil Malmaison (FR)

(72) Inventors: Eric Domejean, Voreppe (FR); Marc Rival, Bernin (FR); Daniel Rota, Vif (FR); Stéphane Dye, Vatilieu (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/842,985

(22) Filed: Apr. 8, 2020

(65) Prior Publication Data

US 2020/0357585 A1 Nov. 12, 2020

(30) Foreign Application Priority Data

May 6, 2019 (FR) ..... 1904724

(51) Int. Cl.
*H01H 33/12* (2006.01)
*H01H 33/02* (2006.01)
(Continued)

(52) U.S. Cl.
CPC ..... *H01H 33/125* (2013.01); *H01H 33/022* (2013.01); *H01H 33/10* (2013.01);
(Continued)

(58) Field of Classification Search
CPC ..... H01H 9/30; H01H 9/345; H01H 33/022; H01H 33/10; H01H 33/125; H01H 33/182;
(Continued)

(56) References Cited

U.S. PATENT DOCUMENTS 7,541,901 B2 * 6/2009 Nakano ..... H01H 9/302 335/201
7,915,985 B2 * 3/2011 Schmitz ..... H01H 9/443 335/201
(Continued)

FOREIGN PATENT DOCUMENTS

CN 102592903 7/2012
CN 103187191 7/2013
(Continued)

OTHER PUBLICATIONS

English Language Machine Translation of Chinese Patent Application Publication No. CN102592903, published on Jul. 18, 2012, 8 pages.
(Continued)

*Primary Examiner* — William A Bolton
(74) *Attorney, Agent, or Firm* — Locke Lord LLP

(57) ABSTRACT

This limiter pole (B) for a multipole DC electrical switch (2) comprises a compartment in which an input terminal and an output terminal for a direct electric current are provided, along with a first electrical contact connected to the input terminal and a second electrical contact connected to the output terminal, third and fourth electrical contacts connected to one another in series, the third and fourth contacts being capable of being moved simultaneously relative to the first and second electrical contacts, respectively, between a closed position, in which the first and third contacts and the second and fourth contacts make contact with one another so as to allow the direct electric current to flow between the input terminal and the output terminal, and an open position, in which said contacts are located away from one another, interrupting the flow of the current between the input terminal and the output terminal. The limiter pole (B) comprises a first electric arc formation chamber in which the first and third electrical contacts are placed, a second electric arc formation chamber in which the second and fourth
(Continued)

electrical contacts are placed, and first and second electric arc extinguishing chambers which are associated with the first and second electric arc formation chambers, respectively.

9 Claims, 10 Drawing Sheets

(51) Int. Cl.
*H01H 33/10* (2006.01)
*H01H 33/18* (2006.01)
*H01H 33/20* (2006.01)
*H01H 33/42* (2006.01)

(52) U.S. Cl.
CPC ..... *H01H 33/182* (2013.01); *H01H 33/42* (2013.01); *H01H 33/20* (2013.01)

(58) Field of Classification Search
CPC .... H01H 33/42; H01H 33/596; H01H 33/346; H01H 33/362; H01H 9/36; H01H 9/40; H01H 71/1045
USPC ..... 218/4–6, 15, 22, 23, 139, 149, 154, 155; 200/9–10, 49, 50.34, 400, 508, 273, 293; 335/16, 201, 202
See application file for complete search history.

(56) References Cited

U.S. PATENT DOCUMENTS 8,368,492 B1 * 2/2013 Theisen ..... H01H 9/36 335/201
8,592,709 B2 11/2013 Newase et al.
8,742,278 B2 * 6/2014 Domejean ..... H01H 71/1045 218/149
8,937,519 B2 * 1/2015 Gerving ..... H01H 1/20 335/201
9,224,559 B2 * 12/2015 Kralik ..... H01H 33/20
9,552,944 B2 * 1/2017 Baujan ..... H01H 33/182
9,552,945 B2 * 1/2017 Britz ..... H01H 33/182
2017/0301490 A1 10/2017 Domejean et al.
2018/0233314 A1 * 8/2018 Oh ..... H01H 71/08

FOREIGN PATENT DOCUMENTS

DE 1257933 1/1968
EP 3232457 10/2017
WO WO2018006770 1/2018

OTHER PUBLICATIONS

English Language Machine Translation of Chinese Patent Application Publication No. CN103187191, published on Jul. 3, 2013, 24 pages.
English Language Machine Translation of German Patent Application Publication No. DE1257933, published on Jan. 4, 1968, 9 pages.
English Language Machine Translation of the Abstract only for International (PCT) Patent Application Publication No. WO2018/006770, published on Jan. 11, 2018, 2 pages.
Written Opinion for French Patent Application No. FR1904724 dated Feb. 17, 2020, 24 pages.
Search Report for French Patent Application No. FR1904724 dated Feb. 7, 2020, 2 pages.

* cited by examiner

ELECTRIC SWITCH LIMITER POLE AND DC ELECTRIC SWITCH COMPRISING SUCH A LIMITER POLE

TECHNICAL FIELD

The present invention relates to a limiter pole for an electrical switch and to a DC electrical switch including such a limiter pole.

BACKGROUND

For electrical installations operating at high voltages, for example 1500 V, DC electrical switches with high ratings (higher than 2000 A) are used. This situation is encountered in particular in photovoltaic installations.

Techniques for decreasing electric arcs, using magnetic circuits, extinguishing chambers provided with separators, arcing contacts and arcing horns, for example known from EP 3 232 457, make it possible to control arcs up to certain voltage and amperage levels. However, for the applications mentioned above, the known techniques are not reliable enough or do not have sufficient current-switching capabilities.

SUMMARY

The invention aims to overcome these drawbacks by providing a novel limiter pole for an electrical switch allowing high-voltage and high-amperage lines to be switched.

To this end, the invention relates to a limiter pole for a multipole DC electrical switch comprising a compartment in which an input terminal and an output terminal for a direct electric current are provided. According to the invention, this limiter pole comprises a first electrical contact connected to the input terminal and a second electrical contact connected to the output terminal, third and fourth electrical contacts connected to one another in series, the third and fourth contacts being capable of being moved simultaneously relative to the first and second electrical contacts, respectively, between a closed position, in which the first and third contacts and the second and fourth contacts make contact with one another so as to allow the direct electric current to flow between the input terminal and the output terminal, and an open position, in which said contacts are located away from one another, interrupting the flow of the current between the input terminal and the output terminal. The limiter pole comprises a first electric arc formation chamber in which the first and third electrical contacts are placed, a second electric arc formation chamber in which the second and fourth electrical contacts are placed, and first and second electric arc extinguishing chambers which are associated with the first and second electric arc formation chambers, respectively.

By virtue of the invention, a double-switching pole is implemented, which makes it possible to form and to isolate the electric arcs that are formed at two different locations and to handle them independently. This makes it possible to increase the amperages flowing through the pole considerably, in particular for voltages of up to 1500 V.

According to advantageous but non-mandatory aspects of the invention, such a limiter pole may incorporate one or more of the following features, in any technically feasible combination:

- the first and second extinguishing chambers comprise separators having protrusions that point in the direction of the electric arc formation chambers and are provided on either side of a median plane of each extinguishing chamber;
- the third and fourth contacts are provided on a first mobile part that is actuated by a switching mechanism of the switch, and the first mobile part includes an electrical connecting element between the third and fourth contacts;
- each of the first and second electric arc formation chambers comprises a magnetic circuit that includes a magnet and generates a magnetic field which is configured to guide, in the direction of the extinguishing chamber associated with this electric arc formation chamber, an electric arc forming, in the open position, between the contacts that are provided in this electric arc formation chamber;
- the first and second electric arc formation chambers are positioned side by side along a longitudinal axis of the switch;
- the third and fourth electrical contacts are each formed by one pair of fingers.

The invention also relates to a high-voltage multipole DC electrical switch, including a moulded housing including a main body that is divided into a plurality of internal compartments, each associated with one pole of the switch, and a switching mechanism. One of the poles of the switch is formed by a limiter pole, the compartment of which is formed by one of the internal compartments of the main body and the contacts of which can be separated by the switching mechanism. The switch comprises at least one conducting pole provided with an input terminal and an output terminal, with a first series of electrical contacts that are connected to the input terminal and with a second series of electrical contacts that are connected to the output terminal, the first and second series of electrical contacts being capable of being separated by the switching mechanism. The switching mechanism is configured to separate the contacts of the one or more conducting poles before the contacts of the limiter pole.

According to advantageous but non-mandatory aspects of the invention, such a switch may incorporate one or more of the following features, in any technically feasible combination:

- the third and fourth contacts of the limiter pole are provided on a first mobile part, the second series of contacts of the conducting pole is provided on a second mobile part, the switching mechanism includes: an actuation shaft on which rotary arms are provided, a first connecting rod connecting one of the rotary arms to the first mobile part, and at least one second connecting rod connecting one of the rotary arms to the second mobile part, and the length of the first connecting rod is greater than the length of the second connecting rod;
- the second series of electrical contacts of the conducting pole includes at least 10 contacts, each borne by one finger that is rigidly connected to a mobile part of this conducting pole, which part is actuated by the switching mechanism;
- this multipole switch includes three conducting poles.

BRIEF DESCRIPTION OF THE DRAWINGS

The invention will be better understood and other advantages thereof will become more clearly apparent in the light of the following description of a pole for a switch and of a switch that are in accordance with its principles, provided by way of nonlimiting example and with reference to the appended drawings, in which.

DETAILED DESCRIPTION

The present invention relates to DC switches with high ratings, for example higher than 2000 A. Such a switch finds application in particular in 1500 V photovoltaic installations or farms.

Figure 1:
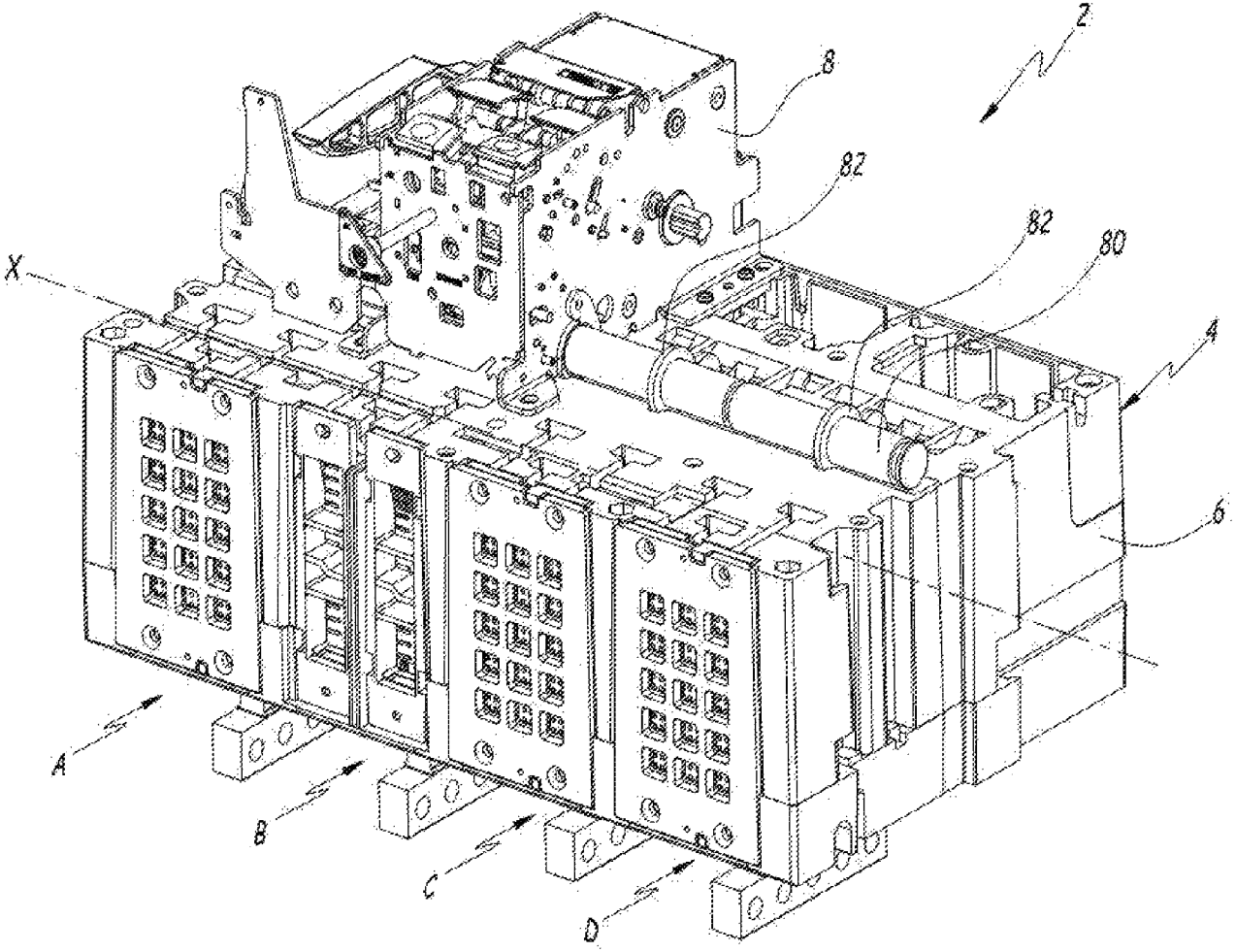
FIG. 1 is a perspective view of a switch according to the invention.

FIG. 1 shows a high-voltage multipole DC electrical switch 2 having a moulded housing 4 including a main body 6 that is divided into a plurality of internal compartments, in this example four compartments 6A, 6B, 6C and 6D that are positioned side by side along a longitudinal axis X of the switch 2. The switch 2 includes a plurality of poles A, B, C and D and each of the compartments 6A, 6B, 6C and 6D is associated with one of the poles A, B, C and D of the switch 2.

The switch 2 also includes a switching mechanism 8 which is tripped when a current has to be interrupted by mechanical, electrical, electronic or other means.

The switch 2 includes a limiter pole, formed by the pole B, which comprises a compartment formed by the compartment 6B of the main body 6. An input terminal 10 and an output terminal 12 for a direct electric current are provided in this compartment 6B. These terminals 10 and 12 are connected to an electricity distribution network and to an electrical apparatus, respectively.

The limiter pole B comprises a first electrical contact 14 that is connected to the input terminal 10 and a second electrical contact 16 that is connected to the output terminal 12. The contacts 14 and 16 are formed by elongate parts that extend from the terminals 10 and 12. The contacts 14 and 16 include contact pads 140 and 160 which form planar surfaces and are positioned side by side along the axis X.

Figure 10:
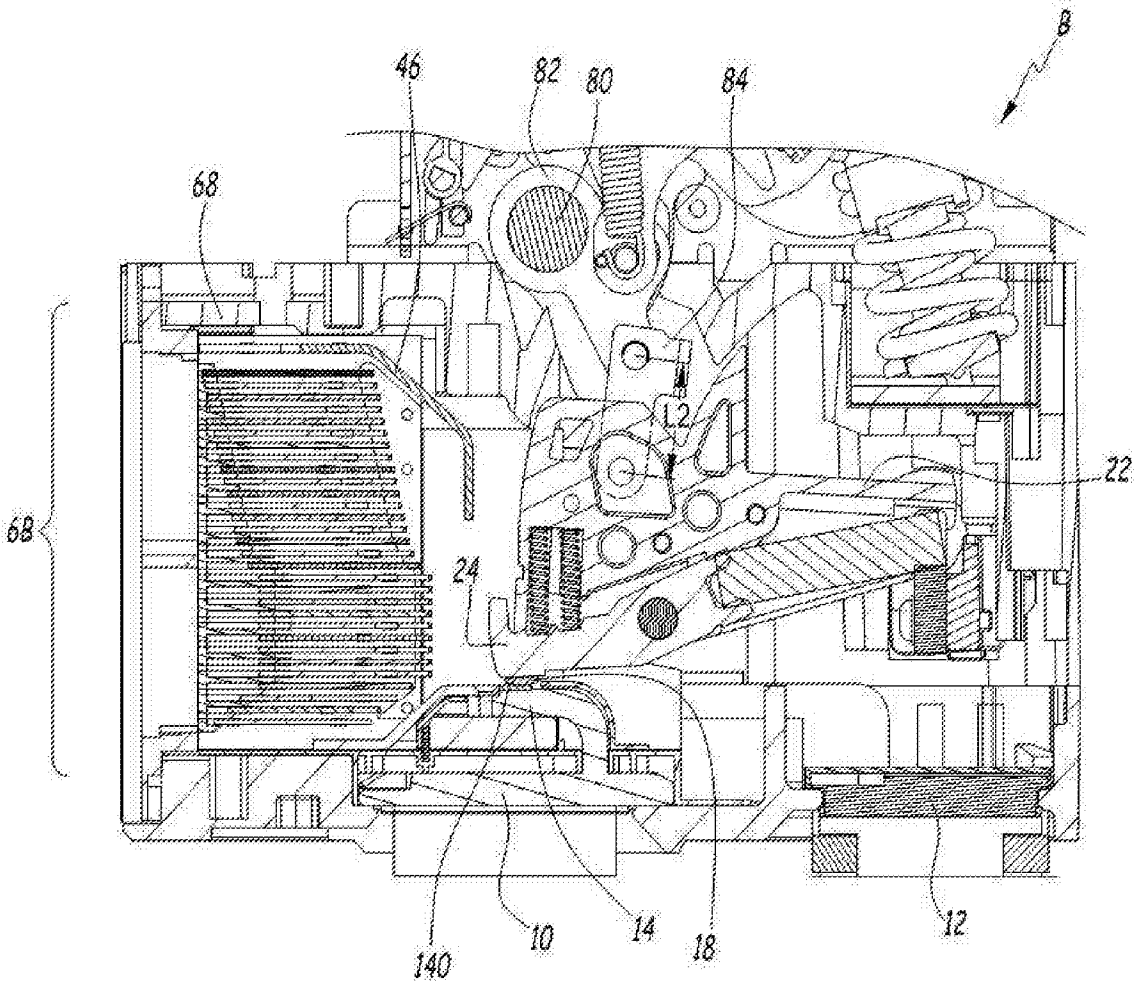
FIG. 10 is a section through the limiter pole along the plane X-X in FIG. 2.

The limiter pole B also comprises a third electrical contact 18 and a fourth electrical contact 20, which are connected to one another in series. These third and fourth contacts 18 and 20 are capable of being moved simultaneously relative to the first and second electrical contacts 14 and 16, respectively, between a closed position and an open position. In the closed position, shown in FIG. 10, the first and third contacts 14 and 18 and the second and fourth contacts 16 and 20 make contact with one another, respectively, so as to allow the direct electric current to flow between the terminals 10 and 12. In FIG. 10, only the contact between the contacts 14 and 18 can be seen, the contacts 16 and 20 being hidden. In the open position, shown in FIGS. 3, 4, 7 and 8, the contacts are located away from one another, interrupting the flow of the current between the terminals 10 and 12. The contacts can be separated by the switching mechanism 8.

The third and fourth contacts 18 and 20 are provided on a mobile part 22 that is actuated by the switching mechanism 8. The mobile part 22 is able to move by rotation about an axis of rotation X22 that runs parallel to the longitudinal axis X.

Each of the contacts 18 and 20 is borne by one respective pair of fingers 24 and 26 that is rigidly connected to the mobile part 22. The contacts 18 and 20 are provided in the form of contact pads that are attached to the pairs of fingers 24 and 26. The pairs of fingers 24 and 26 are able to move by rotation relative to the mobile part 22 about an axis X24, and are pushed in the direction of the contacts 14 and 16 by springs 28 so as to maximize the strength of contact in the closed position.

The mobile part 22 includes an electrical connecting element between the third and fourth contacts 18 and 20 allowing them to be electrically connected in series. This contact element may be a pin 30, made of conductive material, common to the pairs of fingers 24 and 26 and passing through the mobile part 22, aligned with the axis X24 and allowing the pairs of fingers 24 and 26 to be supported while being free to rotate relative to the mobile part 22. The contacts 18 and 20 are then connected in series by conduction through the pin 30.

As a variant, the connection may be made using conductive elements, such as conductive braided connectors 32 and 34 extending between the pairs of fingers 24 and 26 and a conductive pin (not shown) supporting the mobile part 22 in rotation about the axis X22. In such a case, the contacts 18 and 20 are connected in series via the conductive braided connectors 32 and 34 and the aligned conductive pin on the axis X22.

Figure 7:
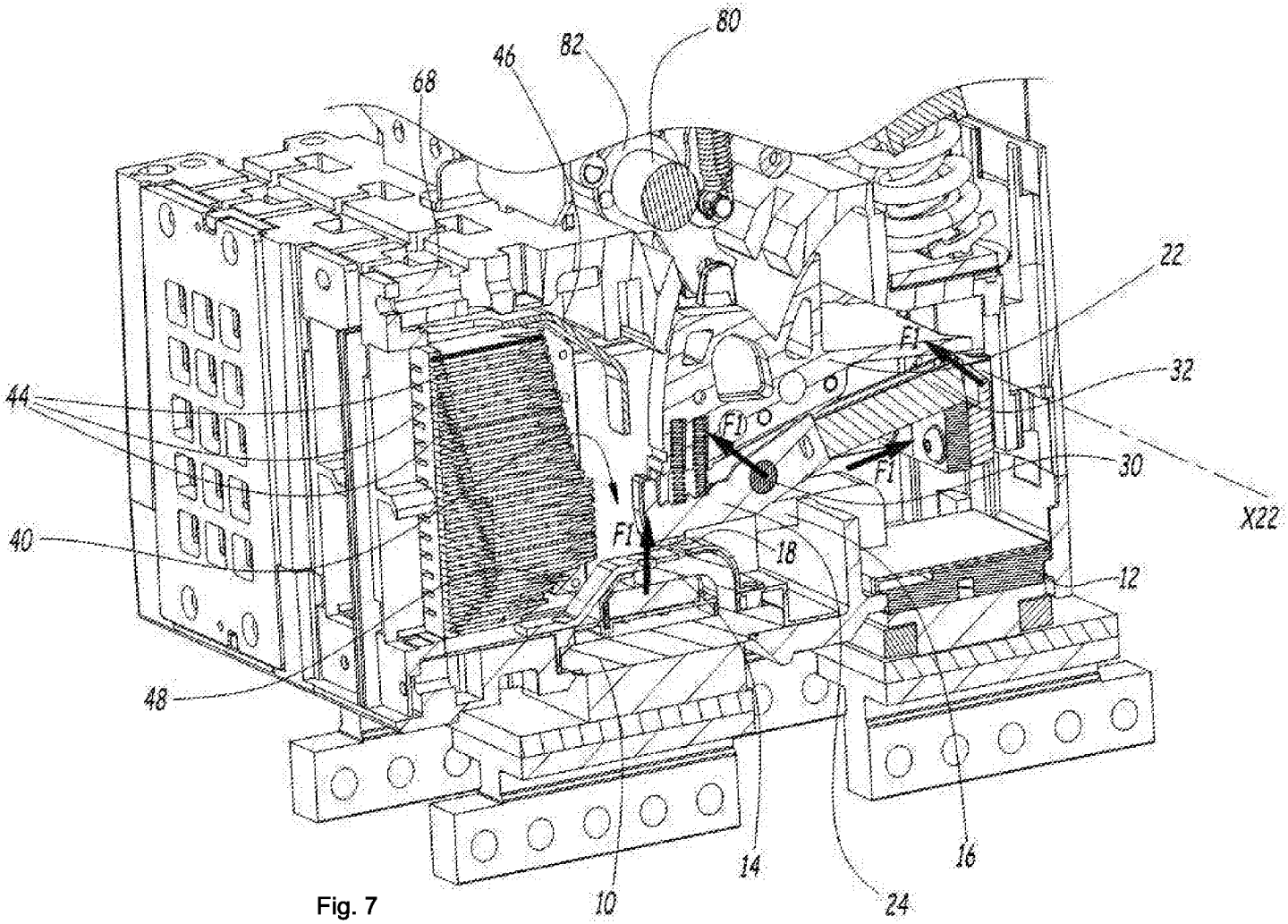
FIG. 7 is a perspective view of the switch of FIG. 1 sectioned through the plane III-Ill.
Figure 8:
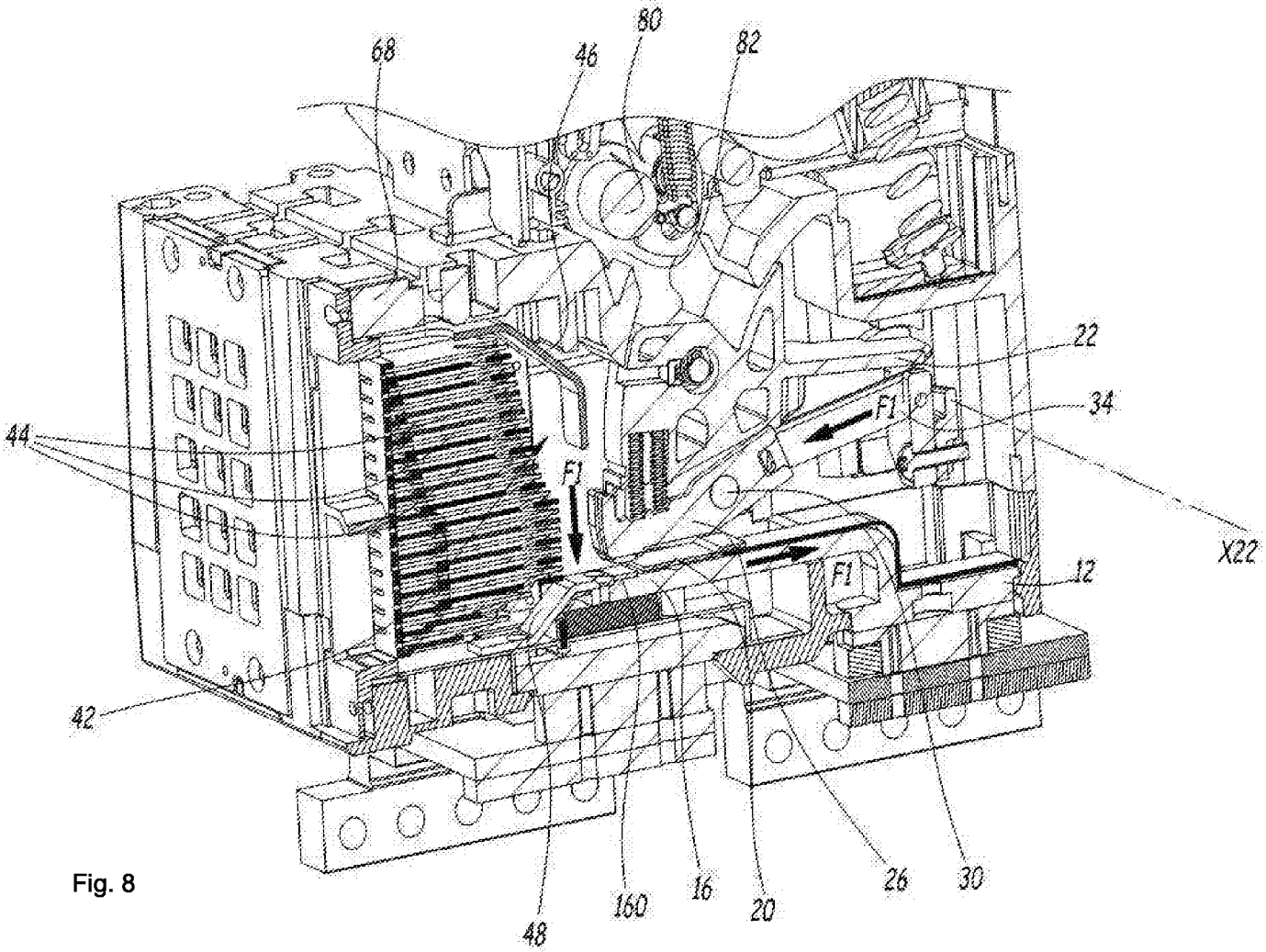
FIG. 8 is a perspective view of the switch of FIG. 1 sectioned through the plane IV-IV.

When the contacts are closed, the current flows, as shown by the arrows F1 in FIGS. 7 and 8, from the terminal 10 to the contact 14, then to the contact 18, then to the contact 20 via the pin 30 or the braided connectors 32 and 34, then to the contact 16 and finally to the terminal 12.

The limiter pole B comprises a first electric arc formation chamber 36, in which the first electrical contact 14 and the third electrical contact 18 are placed. The limiter pole B comprises a second electric arc formation chamber 38, in which the second electrical contact 16 and the fourth electrical contact 20 are placed. The chambers 36 and 38 are where the electric arcs that arise when the contacts are opened are formed. The chambers 36 and 38 are separated, in the direction of the axis X, by a central wall 60 of the main body 6 which runs perpendicular to the axis X to the centre of the compartment 6B.

To extinguish the electric arcs that arise from the separation of the contacts, the limiter pole B also comprises a first extinguishing chamber 40 and a second extinguishing chamber 42, which are associated with the first electric arc formation chamber 36 and with the second electric arc formation chamber 38, respectively. The extinguishing chamber 40 is contiguous with the chamber 36, and these two chambers 36 and 40 form a single space that is delimited, along the axis X, by the central wall 60 and by a wall 62 of the main body 6 which separates the compartment 6B from the compartment 6C. On the other side of the central wall 60, the extinguishing chamber 42 is contiguous with the chamber 38, and these two chambers 38 and 42 form a single space that is delimited, along the axis X, by the central wall 60 and by a wall 64 of the main body 6 which separates the compartment 6B from the compartment 6A. The first and second electric arc formation chambers 36 and 38 are positioned side by side along the axis X.

Each of the first and second extinguishing chambers 40 and 42 comprises separators 44 formed by parallel metal plates that are stacked on planes that run parallel to the axis X. These separators 44, of which there may be 30, are stacked heightwise relative to the compartment 6B between a bottom 66, in the vicinity of which the terminal 10 is located, and an upper wall 68. The separators 44 exhibit central notches 440 which delimit two portions that are located on either side of a median plane P44, perpendicular to the axis X, which is also a median plane of each extinguishing chamber 40 and 42. Advantageously, each separator 44 exhibits protrusions 442 which point in the direction of the electric arc formation chambers 36 and 38 and which partially project into these chambers, and which are provided on either side of the median planes P44 of each extinguishing chamber 40 and 42. These protrusions make it possible to capture electric arcs of low amperage, in particular between 10 A and 100 A, which are not guided in the direction of the axis of the extinguishing chambers 40 and 42 by an electromagnetic force as in the case of electric arcs of high amperage (higher than 100 A, up to 40,000 A).

Each of the extinguishing chambers 40 and 42 includes an arcing contact 46 that runs between the separator 44 at the top of the stack and the upper wall 68 and is directed obliquely into the associated arc formation chamber 36 or 38. The purpose of these arcing contacts is to direct electric arcs towards the separators 44.

Each of the extinguishing chambers 40 and 42 also includes an arcing horn 48 that runs between the bottom 46 and the separator 44 at the bottom of the stack, and is directed towards the respective contact 14 or 16 positioned in the formation chamber 36 or 38 associated with the extinguishing chamber 40 or 42. The purpose of the arcing horns 48 is also to direct electric arcs towards the separators 44.

Each of the first and second electric arc formation chambers 36 and 38 comprises a magnetic circuit that includes a magnet and generates a magnetic field which is configured to guide, in the direction of the extinguishing chamber 40 or 42 associated with this electric arc formation chamber 36 or 38, an electric arc forming, in the open position, between the contacts that are provided in this electric arc formation chamber 36 or 38. More specifically, the electric arc formation chamber 36 includes a magnetic circuit 50, comprising a magnet 500, which is positioned beneath the contact 14, and a bar 502 made of magnetic material in the shape of a "U" which is also positioned beneath the contact 14 and against the magnet 500, and the arms of which extend into the chamber 36 on either side of the pair of fingers 24. A magnetic field generated by the magnet 500 and guided by the bar 502 attracts arcs of low amperage towards the extinguishing chamber 40.

Similarly, the formation chamber 38 includes a magnetic circuit 52, comprising a magnet 520, which is positioned beneath the contact 16, and a bar 522 made of magnetic material in the shape of a "U" which is also positioned beneath the contact 16 and against the magnet 520, and the arms of which extend into the chamber 38 on either side of the pair of fingers 26. A magnetic field generated by the magnet 520 and guided by the bar 522 attracts arcs of low amperage towards the extinguishing chamber 42.

The structure of the limiter pole B allows the current to be switched at two points in series, which allows the electric arcs related to interrupting the current to be divided and handled separately, in two distinct extinguishing chambers. As a result, the voltage that can be switched is much higher than for conventional limiter poles having only one extinguishing chamber. In the present case, the two "arc formation chamber/extinguishing chamber" pairs of the limiter pole B make it possible to switch up to for example 750 V per pair, giving a total of 1500 V, in particular for photovoltaic farms which generate such a voltage.

The switch 2 further includes at least one conducting pole. In this example, the switch 2 includes three conducting poles formed by the poles A, C and D. Only the conducting pole A will be described hereinbelow, since the conducting poles C and D are identical in structure to the conducting pole A.

Figure 2:
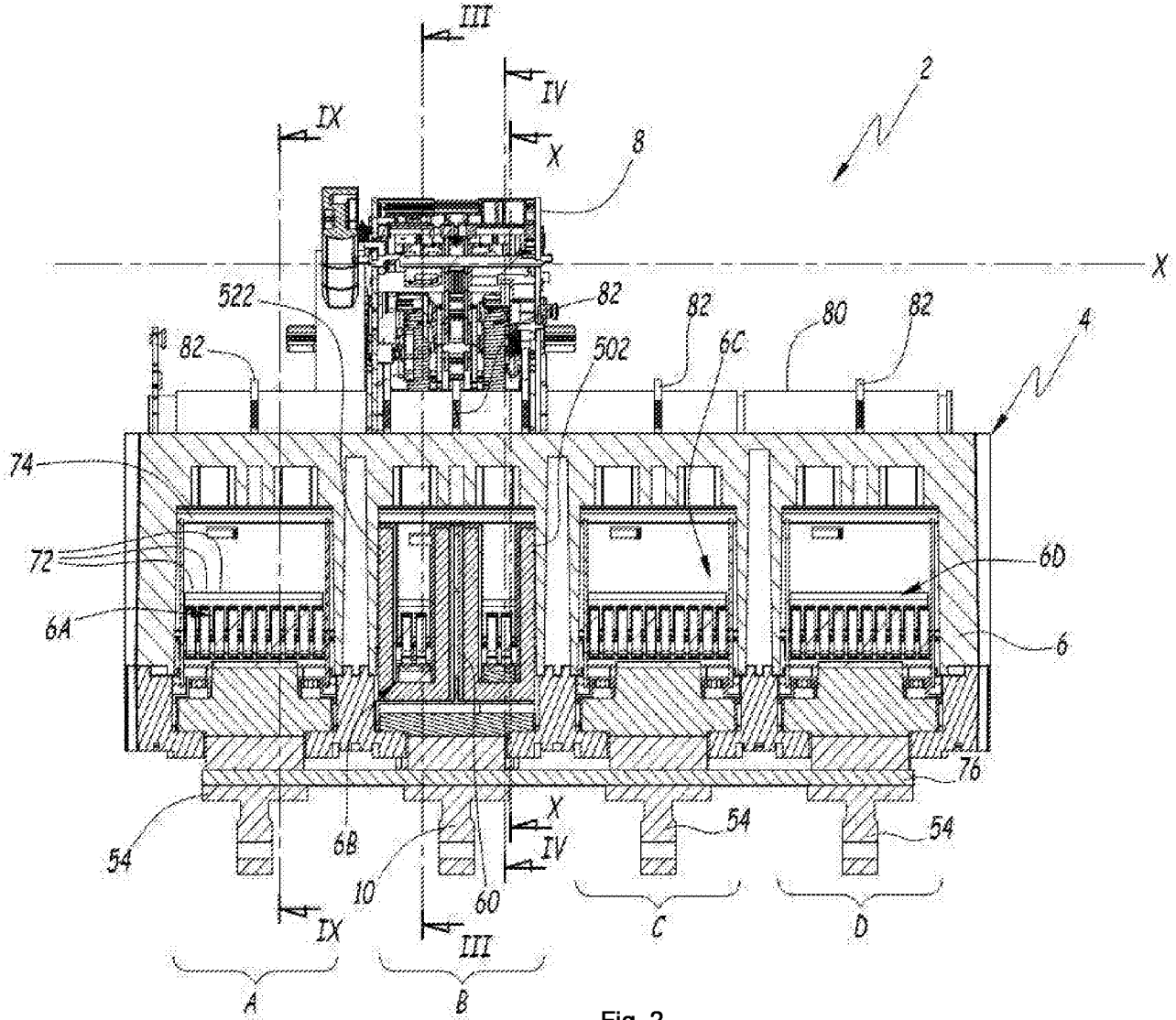
FIG. 2 is a longitudinal section through the switch of FIG. 1.
Figure 3:
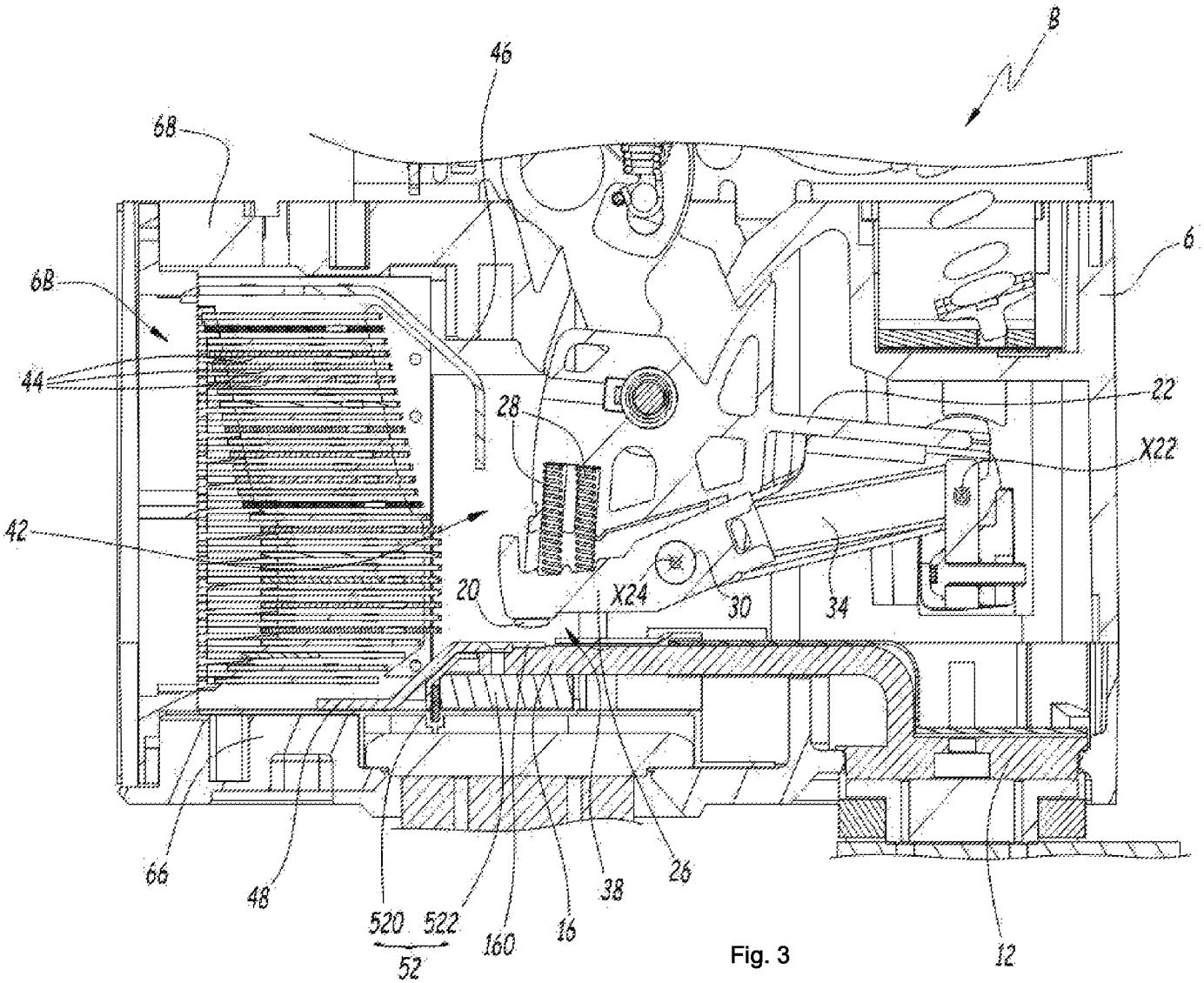
FIG. 3 is a section through the plane III-Ill in FIG. 2 of a limiter pole according to the invention.
Figure 4:
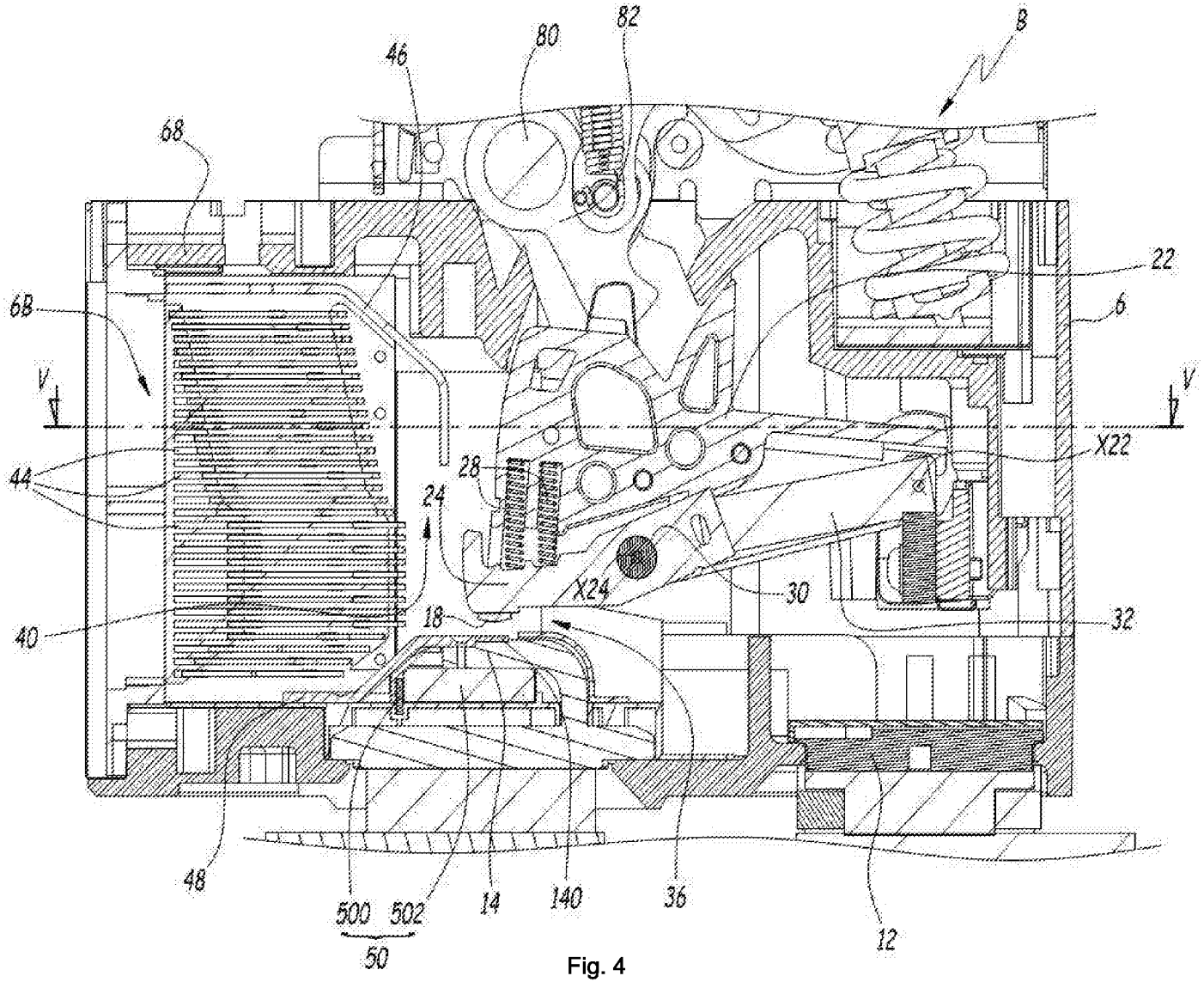
FIG. 4 is a section through the plane IV-IV in FIG. 2 of a pole for a switch according to the invention.
Figure 5:
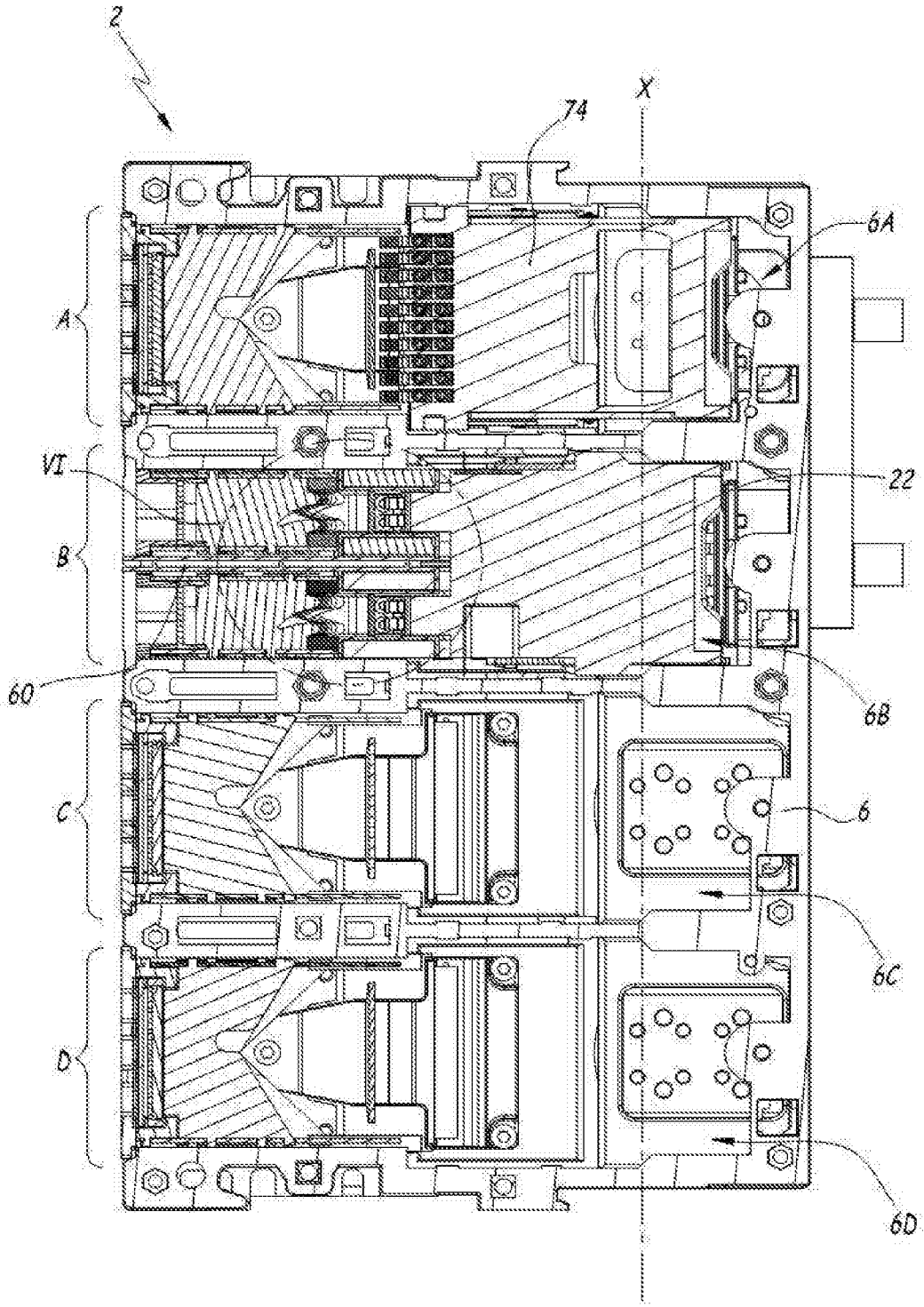
FIG. 5 is a section through the switch of FIG. 1 along the plane V-V in FIG. 4.
Figure 6:
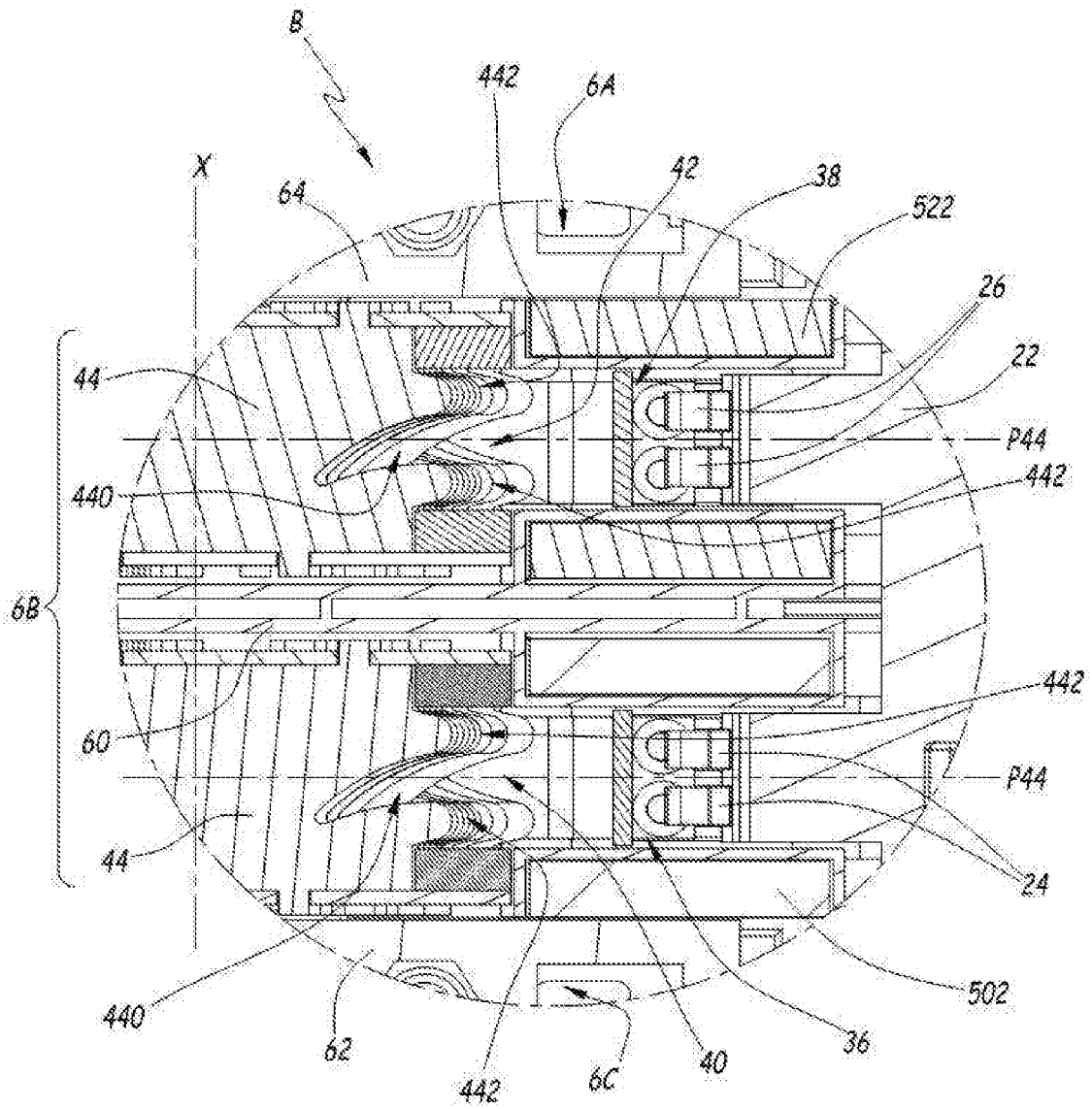
FIG. 6 is an enlarged view of the detail VI in FIG. 5.

The conducting pole A is provided with an input terminal 54 and with an output terminal 56. The conducting poles C and D also each comprise an input terminal 54. As can be seen in FIG. 2, the input terminals 54 of the conducting poles A, C and D and the input terminal 10 of the limiter pole B are connected to one another by an equipotential bar 76. This equipotential bar 76 is an element made of conductive material that is inserted into holes in the three input terminals 54 and in the input terminal 10 and prevents differences in electrical potential between these elements.

Figure 9:
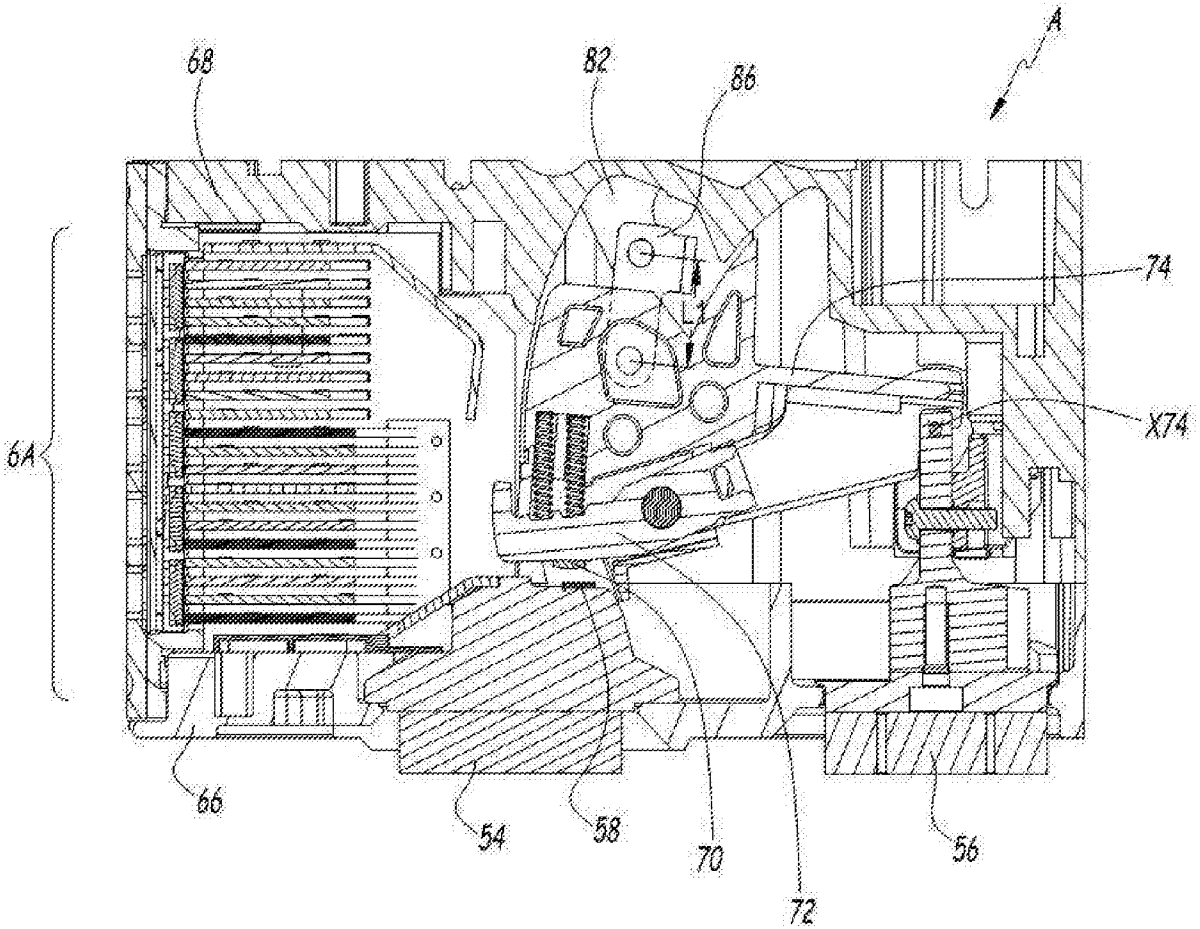
FIG. 9 is a section through a conducting pole for the switch of FIG. 1 along the plane IX-IX in FIG. 2.

The conducting pole A also comprises a first series of electrical contacts 58 that are connected to the input terminal 54, and a second series of electrical contacts 70 that are connected to the output terminal 56. The first and second series of electrical contacts 58 and 70 can be separated by a switching mechanism 8, as can be seen in FIG. 9 with the contacts in an open configuration.

The switching mechanism 8 is configured to separate the contacts of the conducting poles A, C and D before the contacts of the limiter pole B. The poles A, B, C and D are connected in a parallel arrangement. The desired goal is for electric arc effects to be concentrated in the limiter pole B.

The second series of electrical contacts 70 of the conducting pole A includes at least 10 contacts, each borne by a finger 72 that is rigidly connected to a mobile part 74 actuated by the switching mechanism 8. The mobile part 74 is capable of moving by rotation about an axis X74 that runs parallel to the axis X. With the contacts 58 and 70 in the closed configuration, the current flows through the contacts 70 towards the output terminal 56 via the fingers 72 and the mobile part 74.

The switching mechanism 8 includes an actuation shaft 80 on which rotary arms 82 are provided, each of these rotary arms 82 being associated with one of the poles A, B, C and D and the role of which is to actuate the opening of the contacts of this pole. The rotation of the actuation shaft 80 brings about the simultaneous rotation of the rotary arms 82. The rotary arms 82 are connected to the mobile parts 22 and 74 by connecting rods. The switching mechanism 8 comprises a first connecting rod 84 connecting one of the rotary arms 82 to the first mobile part 22, and at least one second connecting rod 86 connecting another rotary arm 82 to the second mobile part 74. In order for the conducting pole A to open before the limiter pole B, the length L2 of the first connecting rod 84 is greater than the length L1 of the second connecting rod 86. This allows, for the time immediately following the opening of the contacts of the conducting pole A (FIG. 9), for the same angle of rotation of the shaft 80, the contacts of the limiter pole B to remain held against one another (FIG. 10).

What is obtained therefore is an offset between the openings, which may for example be of 5°, using mechanical means, i.e. without the intervention of electronic control or other gadgetry. The reliability of the switch 2 is thereby enhanced.

The switch 2 shown in FIG. 2 is a single-pole disconnector switch, for example rated for a current of 10,000 A (by virtue of the three conducting poles A, C and D with 10 fingers in parallel), which may be capable of switching for example 20 kA at a voltage of 1500 V (using the limiter pole B).

According to an embodiment that is not shown, the switch 2 may comprise a number of conducting poles other than three, in particular one or two conducting poles.

The invention claimed is:

1. A high-voltage multipole DC electrical switch, comprising:

a moulded housing including a main body that is divided into a plurality of internal compartments, each associated with one pole of the switch, and a switching mechanism, wherein one of the poles of the switch is formed by a limiter pole, the limiter pole comprising:

a compartment in which an input terminal and an output terminal for a direct electric current are provided, wherein the limiter pole for the multipole DC electrical switch comprises a first electrical contact connected to the input terminal and a second electrical contact connected to the output terminal, third and fourth electrical contacts connected to one another in series, the third and fourth contacts being capable of being moved simultaneously relative to the first and second electrical contacts, respectively, between a closed position, in which the first and third contacts and the second and fourth contacts make contact with one another so as to allow the direct electric current to flow between the input terminal and the output terminal, and an open position, in which said contacts are located away from one another, interrupting the flow of the current between the input terminal and the output terminal, and wherein the limiter pole comprises a first electric arc formation chamber in which the first and third electrical contacts are placed, a second electric arc formation chamber in which the second and fourth electrical contacts are placed, and first and second electric arc extinguishing chambers which are associated with the first and second electric arc formation chambers, respectively, the compartment of which is formed by one of the internal compartments of the main body and the contacts of which can be separated by the switching mechanism, wherein the switch comprises at least one conducting pole provided with an input terminal and an output terminal, with a first series of electrical contacts that are connected to the input terminal and with a second series of electrical contacts that are connected to the output terminal, the first and second series of electrical contacts being capable of being separated by the switching mechanism, and wherein the switching mechanism is configured to separate the contacts of the one or more conducting poles before the contacts of the limiter pole.

2. The high-voltage multipole DC electrical switch according to claim 1, wherein the first and second extinguishing chambers comprise separators having protrusions that point in a direction of the electric arc formation chambers and are provided on either side of a median plane of each extinguishing chamber.

3. The high-voltage multipole DC electrical switch according to claim 1, wherein the third and fourth contacts are provided on a first mobile part that is actuated by a switching mechanism of the switch, and wherein the first mobile part includes an electrical connecting element between the third and fourth contacts.

4. The high-voltage multipole DC electrical switch according to claim 1, wherein each of the first and second electric arc formation chambers comprises a magnetic circuit that includes a magnet and generates a magnetic field which is configured to guide, in a direction of the extinguishing chamber associated with the electric arc formation chamber, an electric arc forming, in the open position, between the contacts that are provided in the electric arc formation chamber.

5. The high-voltage multipole DC electrical switch according to claim 1, wherein the first and second electric arc formation chambers are positioned side by side along a longitudinal axis of the switch.

6. The high-voltage multipole DC electrical switch according to claim 1, wherein the third and fourth electrical contacts are each formed by one pair of fingers.

7. The high-voltage multipole DC electrical switch according to claim 1, wherein the third and fourth contacts of the limiter pole are provided on a first mobile part, wherein the second series of contacts of the conducting pole is provided on a second mobile part, wherein the switching mechanism includes: an actuation shaft on which rotary arms are provided, a first connecting rod connecting one of the rotary arms to the first mobile part, and at least one second connecting rod connecting one of the rotary arms to the second mobile part, and wherein a length of the first connecting rod is greater than a length of the second connecting rod.

8. The high-voltage multipole DC electrical switch according to claim 1, wherein the second series of electrical contacts of the conducting pole includes at least ten contacts, each borne by one finger that is rigidly connected to a mobile part of the conducting pole, which mobile part is actuated by the switching mechanism.

9. The high-voltage multipole DC electrical switch according to claim 1, wherein the switch includes three conducting poles.

* * * * *